United States Patent [19]

Schmidt et al.

[11] Patent Number: 4,610,720

[45] Date of Patent: Sep. 9, 1986

[54] METHOD FOR PREPARING HIGH PURITY VANADIUM

[75] Inventors: Frederick Schmidt; O. Norman Carlson, both of Ames, Iowa

[73] Assignee: The United States of America as represented by the Department of Energy, Washington, D.C.

[21] Appl. No.: 610,905

[22] Filed: May 16, 1984

[51] Int. Cl.[4] ..... C22B 34/22

[52] U.S. Cl. ..... 75/84; 75/27; 75/65 EB

[58] Field of Search ..... 75/84, 27, 21, 63, 65 EB

[56] References Cited

U.S. PATENT DOCUMENTS

| | | | |
|---|---|---|---|
| 3,184,302 | 5/1965 | Chindgren | 75/84 |
| 3,288,594 | 11/1966 | Smith | 75/84 |
| 3,425,826 | 2/1969 | Schmidt et al. | 75/84 |
| 4,169,722 | 10/1979 | Fletcher | 75/27 |
| 4,504,310 | 3/1985 | Boulier | 75/27 |

FOREIGN PATENT DOCUMENTS

| | | | |
|---|---|---|---|
| 665137 | 6/1963 | Canada | 75/84 |

OTHER PUBLICATIONS

Gregory et al., "Production of Ductile Vanadium by Calcium Reduction of Vanadium Trioxide", J. Electrochemical Society, vol. 98, No. 10, Oct. 1951, pp. 395–399.

*Primary Examiner*—John F. Terapane
*Assistant Examiner*—Anne Brooks
*Attorney, Agent, or Firm*—James W. Weinberger; Arthur A. Churm; Judson R. Hightower

[57] ABSTRACT

A method for preparing high purity vanadium having a low silicon content has been developed. Vanadium pentoxide is reduced with a stoichiometric, or slightly deficient amount of aluminum to produce a vanadium-aluminum alloy containing an excess of oxygen. Silicon is removed by electron-beam melting the alloy under oxidizing conditions to promote the formation of SiO which is volatile at elevated temperatures. Excess oxygen is removed by heating the alloy in the presence of calcium metal to form calcium oxide.

9 Claims, No Drawings

METHOD FOR PREPARING HIGH PURITY VANADIUM

CONTRACTUAL ORIGIN OF THE INVENTION

The U.S. States Government has rights in this invention pursuant to Contract No. W-7405-ENG-82 between the U.S. Department of Energy and Iowa State University.

BACKGROUND OF THE INVENTION

This invention relates to a method for preparing high purity vanadium metal. More specifically, this invention relates to a method of preparing high purity vanadium metal which is relatively free of silicon from commercial grade vanadium pentoxide.

There is a great deal of interest in vanadium for use in several important high technology applications. Vanadium-based-alloys have a low capture cross-section for high energy neutrons and are resistant to void swelling, and so are being considered as a candidate material for cladding and ducts in fast breeder reactors and as a first wall in fusion reactors. Another use for vanadium is the super-conducting A15 compound, $V_3Ga$ which has a higher critical current density ($J_c$) than $Nb_3Sn$ in magnetic field intensities larger than 6 tesla, in the temperature range of 4.2 to 10 K. However, investigations have indicated that the presence of silicon may have a detrimental effect on the superconducting and fabrication properties of vanadium alloys.

Efforts to purify vanadium of silicon have proven to be difficult and/or expensive. For example silicon in vanadium cannot be removed by electrotransport purification due to its relative immobility in the vanadium matrix. Nor can silicon be preferentially evaporated from vanadium during electron beam float zone melting (EBFZM) even though the relative vapor pressures of vanadium and silicon would indicate this might occur.

Most commercial grades of vanadium, metal contain between 200 and 800 ppmw parts per million weight silicon in addition to small amounts of aluminum, carbon, iron and molybdenum. Commercial grade $V_2O_5$ generally contains 300–400 ppm silicon which carries over to the vanadium metal upon reduction. At present, reduction of silicon in vanadium metal can be accomplished by either reducing the silicon content in the $V_2O_5$ before reduction to the metal or by removing silicon from the already reduced metal.

Methods for reducing silicon in the pentoxide include: fusing the vanadium pentoxide with ammonium bifluoride. Upon dissolution in water followed by reprecipitation as ammonium metavanadate, an oxide product is produced in which the silicon content is decreased from 250 ppmw to approximately 75 ppmw. Another method involves an ion exchange separation and consists of absorbing $VO^{++}$and $Fe^{3+}$ions on an ion exchange column while the $Si^{4+}$ions pass through. The vanadium and iron ions on the column are then separated by complexing with ethylenediaminetetraacetic acid (EDTA) and the vanadium is recovered as the purified pentoxide containing less than 10 ppmw of both silicon and iron.

Silicon can be removed from vanadium metal by an iodine refining process in which the silicon content is reduced from 300 ppmw to about 50 ppmw. A fused salt electrorefining process was found capable of removing virtually all of the silicon from vanadium. In this process feed material containing 4200 ppmw Si was purified into metal containing about 60 ppmw Si in a single refining step using a $LiCl$-$KCl$-$VCl_2$ electrolyte. By a double electrorefining step, silicon content was further reduced to about 15 ppmw.

Quantities of commercial grade, low-oxygen vanadium metal are produced by the aluminothermic reduction of commercial grade $V_2O_5$ in a water-cooled crucible, as described in *J. Metals,* 18 (3) (1966), pp. 320–323. The essential feature of the process is the addition of an excess of aluminum metal to form a vanadium-11% aluminum alloy containing about 0.5% oxygen as the reduction product. The excess aluminum is present in the alloy so that upon subsequent heating in vacuum at high temperatures, the aluminum is vaporized, simultaneously removing the residual oxygen as the volatile suboxide, $Al_2O$. The resulting sponge product is then electron-beam melted to yield metal of 99.9+% purity containing about 50 ppmw oxygen. The product also contains about 500 ppmw silicon, which is virtually the same silicon that was in the $V_2O_5$ starting material, since the reaction process removes little or no silicon.

All of the above methods which remove silicon from either $V_2O_5$ or vanadium metal are complex and hence expensive processes which greatly increase the cost of vanadium, while the usual method for the reduction of $V_2O_5$ removes little or none of the silicon which was present in the starting material. What is needed is a relatively inexpensive process which will reduce commercial grade vanadium pentoxide to the metal while decreasing the silicon content at the same time.

SUMMARY OF THE INVENTION

An improvement has been made in the aluminothermic method of reducing commercial grade $V_2O_5$ to vanadium metal which results in a substantial reduction in the silicon content of the vanadium metal.

According to the method of the invention for preparing high-purity, low-silicon vanadium metal, vanadium pentoxide containing silicon, iron, and other impurities is mixed with aluminum metal to form a reduction mixture, the aluminum in the mixture varying from stoichiometric to a 10% deficiency in the amount necessary to reduce the vanadium pentoxide to vanadium metal, heating the mixture under reducing conditions to form a vanadium-aluminum alloy containing iron, silicon, and an excess of oxygen. The alloy is then heated under reduced pressure to a temperature sufficient to vaporize the aluminum and iron and to react the oxygen in the alloy with the silicon to form SiO which vaporizes away from the metal thereby removing the silicon forming a high purity vanadium metal containing oxygen. The oxygen-containing vanadium metal is then heated in the presence of calcium metal to a temperature and for a period of time sufficient for the oxygen to diffuse from the metal and react with the calcium to form calcium oxide, thus removing the oxygen from the vanadium and forming high-purity, low-silicon vanadium metal.

It is therefore one object of the invention to provide an improved method for preparing high purity vanadium metal.

It is another object of the invention to produce a method for preparing high-purity, low-silicon vanadium metal from commercial grade vanadium pentoxide.

Finally it is the object of the invention to provide an improved aluminothermic method for preparing high-purity low-silicon vanadium metal from commercial grade vanadium pentoxide containing silicon and other impurities.

DETAILED DESCRIPTION OF THE PREFERRED EMBODIMENT

These and other objects of the invention may be met by mixing finely divided vanadium pentoxide containing iron, silicon and other impurities with finely divided high-purity aluminum metal to form a reduction mixture, the aluminum in the mixture varying from stoichiometric to about a 5% deficiency of the amount necessary to reduce the vanadium pentoxide to vanadium metal, heating the mixture in a reduction bomb under reducing conditions to reaction temperatures to reduce the vanadium pentoxide and form a vanadium-aluminum alloy containing from about 1.5 to about 0.6% oxygen in addition to some silicon and iron; electron beam melting the alloy under a reduced pressure of, from about $2\times10^{-5}$ to about $2\times10^{-6}$ torr, to vaporize the aluminum and iron in the alloy and to react some of the oxygen with some of the silicon to form some silicon monoxide which vaporizes away from the metal, thereby re-moving some of the silicon and oxygen from the metal billet, electron beam melting the vanadium metal billet a second time under reduced pressure to react oxygen and silicon to form volatile silicon monoxide thereby removing more silicon and oxygen from the metal, and forming the molten vanadium metal containing oxygen into platlets having a thickness of about 2.0 mm; heating the vanadium metal platlets in the presence of calcium metal under an atmosphere of argon to about 1000° C. for a period of time sufficient for the oxygen in the metal to diffuse to the surface of the metal and react with the calcium to form calcium oxide, contacting the vanadium metal platelets with acetic acid to remove any calcium oxide from the surface of the metal; and heating the calcium oxide-free metal under a vacuum to 800° C. for a period of time sufficient to remove any remaining oxygen and hydrogen from the metal, thereby forming high-purity, low-silicon vanadium metal.

The aluminum used for the reduction is preferably of high purity, i.e. no more than about 10–20 ppmw carbon, 5 ppmw nitrogen, 50 ppmw iron and <50 ppmw silicon. This is important since certain impurities such as silicon will end up in the reduced vanadium metal rather than in the slag. The amount of aluminum in the reduction mixture may vary from about a 10% deficiency, preferably a 5% deficiency, to a stoichiometric amount necessary to reduce vanadium pentoxide to vandium metal. This will generally provide an oxygen content in the reduced metal from about 0.6% for a stoichiometric amount of aluminum to about 3% oxygen for a 10% deficiency. A yield of about a 1.5% oxygen content, is preferred as a balance between providing sufficient oxygen in the reduced metal to react with the silicon and providing a respectable yield of vanadium metal from the reduced pentoxide.

Preferably, the reduction is carried out by the "bomb" reduction process using a water-cooled copper crucible, although other reduction methods may also be suitable. It is necessary to initiate the reduction reaction using a reaction trigger such as a mixture of iodine, aluminum and vanadium pentoxide. The use of such a trigger is well known to those skilled in the art. The $V_2O_5$ and aluminum in the reaction mixture are present in a finely divided form such as a powder or metal turnings to assure a complete reaction.

After the reduction process is carried out, the massive vanadium-aluminum alloy is electron beam melted under reduced pressure of from about $5\times10^{-4}$ to about $5\times10^{-7}$ torr, preferably $5\times10^{-6}$ to $4\times10^{-6}$ torr to vaporize most of the residual aluminum and iron from the metal and to react the oxygen with the silicon to form silicon monoxide which is volatile and vaporizes, thus removing both oxygen and silicon from the metal and forming a vanadium metal billet.

Preferably the vanadium metal billet is electron beam melted a second time under reduced pressure to further purify the metal by vaporizing any aluminum which may remain and to react additional oxygen and silicon which may remain in the metal. Preferably also, the metal, as it is melted, is formed into thin platelets which may be up to 8 mm, preferably no more than about 2.0 mm in thickness in order to simplify oxygen removal from the metal. Metal pieces of greater thickness, up to ½ inch thick or more may be used but will require longer periods of time for diffusion of the oxygen to the surface of the metal where it can react with the calcium.

Excess oxygen is removed from the vanadium metal by heating the vanadium metal, preferably as platelets in a sealed container in the presence of calcium metal for a period of time sufficient for the oxygen in the metal to diffuse to the surface of the metal where it can react with the calcium, forming calcium oxide. The amount of calcium is not critical, but must be sufficient to react with the oxygen which diffuses from the metal. The container may be sealed under an atmosphere of argon, which may be from about 200 to 760 torr, or the container may be sealed under a vacuum, which is not critical and which may be about $5\times10^{-5}$ torr or lower. Times required for the oxygen to diffuse will depend upon the size of the metal pieces. For coupons 1.5 mm in thickness, about 43 hours at 1000° C. was found satisfactory to reduce the $O_2$ content down to 40 to 60 ppmw. Diffusion temperature may range from as low as 800° C., preferably 900° C. to 1000° C. or higher, the higher temperatures decreasing the amount of time required to diffuse the oxygen from the metal.

The calcium oxide coating which forms on the vanadium metal can be readily removed by contacting the coated metal with an appropriate solvent which will dissolve the calcium oxide. One suitable solvent was found to be acetic acid. Use of an acid introduces hydrogen into the metal since hydrogen formed from the reaction of the acid and calcium is readily soluble in the high purity vanadium. This may necessitate an additional step of vacuum degassing the metal under suitable conditions to remove the hydrogen from the alloy. Generally treatment for one hour at about 800° C. at $5\times10^{-5}$ to $5\times10^{-6}$ torr is satisfactory to completely dehydride the metal. Higher temperatures may also be used.

The following Examples are given to illustrate the method of the invention and are not to be taken as limiting the scope of the invention which is defined by the appended claims.

EXAMPLE I 819 gm of $V_2O_5$ (powder) (AO-5236) which had been dried of residual moisture was mixed with 405 g. of aluminum millings which corresponds to the stoichiometric amount necessary for reduction. A trigger mixture consisting of 90 g. $V_2O_5$, 49 g. of aluminum powder and 20 g. of iodine were used. The reduction was made in a sealed 10 cm diameter water-cooled copper crucible. The reaction was initiated by internally heating a vanadium filament embedded in the trigger mixture. The resulting vanadium-metal alloy weighed 458 grams and contained 0.6% oxygen. The reguli from this step were sectioned and the pieces welded in tandem to form bars suitable for electron beam melting. The alloy was electron beam melted in a 60 Kw electron-beam furnace equipped with a remote gun into ingot form (BEB-1-460). A 0.32 cm thick slice was cut from the ingot and heated with calcium at 1000° C. for 43 hours in a sealed tantalum crucible. After removal of calcium oxide powder from the surface of the metal, it was heated to 800° C. in a vacuum of $5\times10^{-6}$ torr for 1 hour to degas the metal. The analyses of the metal after the various steps of processing are shown in Table I.

TABLE I

Analyses of material at various processing stages of modified process using stoichiometric amount of aluminum. Impurity content in ppmw

| Impurities or Hardness | As Reduced | Concentration, wt. ppm After Electron Beam Melting | After Ca Treatment | After Vacuum Heating |
|---|---|---|---|---|
| Aluminum | >1000 | 800 | ~1100 | |
| Calcium | <30 | <30 | <30 | |
| Carbon | 30 | 10 | 20 | |
| Copper | >1000 | <20 | <20 | |
| Hydrogen | 180 | 65 | 1400 | 7 |
| Iron | 700 | 300 | 300 | |
| Nickel | 250 | 140 | 70 | |
| Nitrogen | 50 | 95 | 40 | 55 |
| Oxygen | 6000 | 3000 | 40 | 25 |
| Silicon | 225 | 85 | 80 | |
| DPH | 172 | 224 | 76 | 68 |

EXAMPLE II 819 g. of $V_2O_5$ (AO-5326), which had been previously treated in the same manner as described in Example #1, was reduced with 385 grams of aluminum which corresponds to a 5% deficiency of the stoichiometric amount. The reduction and subsequent processing steps were performed in exactly the same way as described in Example #1. The as-reduced vanadium-oxygen alloy weighed 452 g. Table II shows the analysis of the metal after the various processing steps.

TABLE II

Analysis for 5% aluminum deficiency experiment Impurity content in ppmw

| Impurities or Hardness | As Reduced | Concentration, wt. ppm After Electron Beam Melting | After Ca Treatment | After Vacuum Heating |
|---|---|---|---|---|
| Aluminum | >>1000 | 300 | 600 | |
| Calcium | <30 | <30 | <30 | |
| Carbon | 35 | 10 | 25 | |
| Copper | >1000 | <20 | <20 | |
| Hydrogen | 280 | 165 | 2600 | 17 |
| Iron | 300 | 170 | 200 | |
| Nickel | 30 | 30 | <40 | |
| Nitrogen | 135 | 110 | 25 | 30 |
| Oxygen | 17,000 | 7600 | 60 | 60 |
| Silicon | 340 | 80 | 80 | |
| DPH | 150 | 447 | | 50 |

A comparison of the data in Tables I and II shows that most of the silicon, aluminum and carbon along with about half the oxygen and iron were removed during a single electron beam melting step. The 50 DPH hardness of the vanadium of Table II compares favorably to a value of 45 DPH for electrotransport purified vanadium of 99.947 purity.

EXAMPLE III

Two identical charges, each consisting of 819 grams of finely divided $V_2O_5$, mixed with a stoichiometric amount consisting of 405 grams of aluminum millings. The charge was placed in a 10 cm diameter water-cooled copper crucible. A trigger mixture of 90 grams $V_2O_5$,ϕ49 grams aluminum turnings and 20 grams of iodine were placed in the charge. A vanadium heater filament was placed in the trigger mixture as an igniter. The crucible was vacuum flushed, sealed and the trigger fired to initiate the reduction reaction. The resulting reduction product, in the form of two 10 cm round hemispheres were cut in half and the resulting half pieces from the two charges were welded in tandem to form an electrode.

The welded electrode was electron beam melted to form a 5 cm diameter ingot. This ingot was again electron beam melted onto a vibrating, water-cooled copper pedestal to form a plurality of platelets measuring from about 025 to 0.5 mm in thickness. The platelets, so formed, were sealed with calcium in a tantalum can and heated for 24 hours at 1000° C. to remove the oxygen from the platelets.

An analyses of the content of the reduction product was made after each step and as given in Table III below. Carbon content was analyzed by combustion chromatographic analyses, silicon and metals were analyzed by emission spectroscopy and oxygen, nitrogen, and hydrogen were analyzed by vacuum fusion analysis.

TABLE III

| Element | As Reduced #1 (FRS-37-75) | As Reduced #2 (FRS-37-77) | As Electron Beam Melted into ingot (BEB-1-481) | As Electron Beam Melted into platelets (BEB-1-483) | After heating with Ca 24 hr @ 1000° C. (FRS-37-174) |
|---|---|---|---|---|---|
| C | 70 | 28 | 42 | 17 | 9 |
| O | 6,300 | 11,000 | 2,200 | 5,200 | 29 |
| N | 57 | 90 | 51 | 63 | 30 |
| H | — | — | 55 | 170 | 24 |
| Si | 590 | 450 | 390 | 360 | 290 |
| Al | >1000 | >1000 | >1000 | >1000 | >1000 |
| Ca | <30 | <30 | <30 | <30 | <30 |
| Cr | 255 | 225 | ≦80 | ≦80 | 180 |
| Fe | 245 | 245 | 155 | 180 | 155 |
| Cu | 160 | 330 | <25 | <25 | <25 |
| Mg | 24 | <15 | <15 | <15 | <15 |

TABLE III-continued

| Element | As Reduced #1 (FRS-37-75) | As Reduced #2 (FRS-37-77) | As Electron Beam Melted into ingot (BEB-1-481) | As Electron Beam Melted into platelets (BEB-1-483) | After heating with Ca 24 hr @ 1000° C. (FRS-37-174) |
|---|---|---|---|---|---|
| Ni | 30 | 30 | <25 | <25 | <25 |
| Ti | <20 | <20 | <25 | <25 | 70 |

Al content can be lowered by slower electron-beam melt. Si content decreased from average value (#1 and #2) of 520 and 290 wt ppm and should be further decreased using a slower electron-beam melt.

The table shows that the silicon content of the final product, 290 ppmw, was substantially reduced over the silicon content of the average of the reduced metal product of 520 ppmw.

EXAMPLE IV

In a manner similar to Example III, two charges were prepared except that 385 grams of aluminum turnings were mixed with 819 grams of $V_2O_5$ to prepare a mixture containing a 5% deficiency of aluminum as the reducing agent. The charges were heated to reducing temperature and the resulting ingots treated as described before. The results of the various analysis are given in Table IV below.

TABLE IV

| Element | As Reduced #1 (FRS-37-83) | As Reduced #2 (FRS-37-85) | As Electron Beam Melted into ingot (BEB-1-480) | As Electron Beam melted into platelets (BEB-1-484) | After heating with Ca 24 hr @ 1000° C. (FRS-37-175) |
|---|---|---|---|---|---|
| C | 28 | 68 | 19 | 15 | 15 |
| O | 13,500 | 15,500 | 11,000 | 11,000 | 11 |
| N | 170 | 190 | 37 | 89 | 37 |
| H | — | — | 110 | 100 | 19 |
| Si | 480 | 580 | 400 | 235 | 230 |
| Al | >1000 | >1000 | >1000 | >1000 | >1000 |
| Ca | <30 | <30 | <30 | <30 | <30 |
| Cr | 260 | 220 | ≦80 | ≦80 | ≦80 |
| Fe | 230 | 240 | 190 | 105 | 145 |
| Cu | 330 | 95 | <25 | <25 | <25 |
| Mg | <15 | <15 | <15 | <15 | <15 |
| Ni | <20 | 25 | <25 | <25 | <25 |
| Ti | <20 | <20 | <25 | <25 | <25 |

Al content can be lowered by slower electron-beam melt. Si content decreased from average value (#1 and #2) of 530 to 230 wt ppm and should be further decreased using a slower electron-beam melt.

In this example the average silicon content of the two charges, as reduced, of 530 ppmw, was lowered to 230 ppmw by the process of the invention.

EXAMPLE V

Two additional charges were prepared and reduced as before except that 365 grams of aluminum turings were added to the 819 grams of $V_2O_5$ to provide a 10% deficiency of aluminum. In addition, 3000 wt ppm Si was added as $SiO_2$ to the charges. The charges were then reduced and the resulting alloy electron beam melted as before. The results of the various analysis are given in Table V below.

TABLE V

| Element | As Reduced #1 (FRS-37-87) | As Reduced #2 (FRS-37-89) | As Electron Beam Melted into ingot (BEB-1-482) | As Electron Beam Melted into platelets (BEB-1-485) | After heating with Ca 24 hr @ 1000° C. (FRS-37-176) |
|---|---|---|---|---|---|
| C | 69 | 76 | 18 | 15 | 35 |
| O | 17,500 | 26,000 | 12,000 | 18,000 | 14,000 |
| N | 1,100 | 43,000 | 12,000 | 7,700 | 68 |
| H | — | — | 250 | 300 | 330 |
| Si | >1000 | >1000 | >1000 | <900 | <900 |
| Al | >1000 | >1000 | >1000 | >1000 | >1000 |
| Ca | <30 | <30 | 55 | <30 | <47 |
| Cr | 225 | 245 | ≦80 | ≦80 | ≦80 |
| Fe | 280 | 290 | 200 | 190 | 170 |
| Cu | 200 | 270 | <25 | <25 | <25 |
| Mg | <15 | <15 | <15 | <15 | <15 |
| Ni | <20 | 25 | <25 | <25 | <25 |
| Ti | <20 | <20 | <25 | <25 | <31 |

Oxygen not removed by Ca treatment maybe due to high Si. Decrease in N content after Ca treatment may be real or analytical problem due to high oxygen content. Si content still greater than 1000 wt ppm.

It is not known why the oxygen was not removed by the calcium, possibly it was due to the high silicon content. Nor is it known why more silicon was not removed by the process. In all of the Examples, the aluminum content can easily be reduced further by slower electron beam melting to allow greater times for aluminum to boil off. It is believed that the silicon content can also be reduced still further using a slower electron-beam melting technique.

EXAMPLE VI

An electron beam melted platelet from each of the preceding three batches were heated separately in calcium vapor at 1000° C. for 48 hours. The results of the analysis is given below in Table VI.

TABLE VI

| | FRS-37-184-1 (Stoich. Al) | FRS-37-184-2 (5% def. Al) | FRS-37-184-3 (10% def + 3000 ppm Si added) |
|---|---|---|---|
| C | 23 | 20 | 34 |
| O | 160 | 76 | 840 |
| N | 26 | 26 | 68 |
| H | 18 | 77 | 33 |
| Si | 330 | 135 | 900 |
| Al | >1000 | 650 | 570 |
| Ca | <30 | <30 | <30 |
| Cr | ≦80 | ≦80 | ≦80 |
| Fe | 84 | 76 | 97 |
| Cu | <25 | <25 | <25 |
| Mg | <15 | <15 | <15 |
| Ni | <25 | <25 | <25 |
| Ti | <25 | <25 | <25 |

The analysis show a further reduction in most instances of both the oxygen and the silicon content of the platelets.

As can be seen from the preceding discussions and Examples, the method of the invention provides an improved process for the preparation of high purity, low silicon vanadium metal.

The embodiments of this invention in which an exclusive property or privilege is claimed are defined as follows:

1. A method of preparing high-purity, low-silicon vanadium metal from vanadium pentoxide containing silicon, iron and other impurities comprising:

mixing the vanadium pentoxide with aluminum to form a reaction mixture, the quantity of aluminum in the mixture being from about stoichiometric to about 10% deficient in the amount necessary to completely reduct the vanadium pentoxide to vanadium metal:

heating the mixture under reducing conditions to a temperature sufficient to react the mixture to reduce the vanadium pentoxide and form a vanadium-aluminum alloy containing silicon, iron and from about 0.6 to about 3 weight percent oxygen;

heating the alloy under reduced pressure to a temperature sufficient to vaporize the aluminum and iron in the alloy and to react the silicon with some of the oxygen to form volatile silicon monoxide which vaporizes away from the alloy thereby removing aluminum, iron, silicon and some of the oxygen from the vanadium metal, and heating the vanadium metal in the presence of calcium metal to a temperature and for a period of time sufficient for the oxygen to diffuse from the vanadium and react with the calcium to form calcium oxide, thereby removing oxygen from the vanadium metal, forming a high-purity, low-silicon vanadium metal.

2. The method of claim 1 wherein the vanadium-aluminum alloy containing silicon, iron and oxygen is electron beam melted under a pressure of from about $5\times10^{-4}$ to about $5\times10^{-7}$ torr to form vanadium metal.

3. The method of claim 2 including the additional steps of:

melting the vanadium metal a second time by electron beam melting under reduced pressure to vaporize any remaining aluminum and to react any remaining silicon with oxygen to from volatile silicon monoxide, and forming the molten vanadium metal into platelets up to about 8 mm in thickness.

4. The method of claim 3 wherein the platelets are heated in the presence of calcium metal to a temperature of at least 800° C. for a period of time sufficient for oxygen in the metal to diffuse from the vanadium metal and react with the calcium metal, forming calcium oxide on the surface of the platelet.

5. The method of claim 4 wherein the metal platelets are contacted with a solvent to remove the calcium oxide.

6. The method of claim 5 wherein the solvent is an acid.

7. The method of claim 6 wherein the platelets are heated to about 800° C. at a vacuum of at least $5\times10^{-5}$ torr for a period of time sufficient to dehydride the platelets.

8. The method of claim 8 wherein the acid is acetic acid.

9. A method of preparing high purity, low silicon vanadium metal from vanadium pentoxide containing silicon, iron and other impurities comprising:

mixing vanadium pentoxide with aluminum to form a reaction mixture, the quantity of aluminum in the mixture being about 5% deficient in the amount necessary to completely reduce the vandium pentoxide to vanadium metal, heating the mixture in a reduction bomb to a temperatue sufficient to react the aluminum and the vanadium pentoxide to form an aluminum-vanadium alloy containing silicon, iron, and about 1.5% oxygen, melting the alloy by electron beam melting at a pressure from about $2\times10^{-5}$ to about $2\times10^{-6}$ torr to vaporize the aluminum and iron and to react the silicon with some of the oxygen, forming volatile silicon monoxide which vaporizes away, thus removing the silicon from the vanadium metal;

forming the molten vanadium metal containing oxygen into platelets have a thickness of up to about 2 mm, heating the platelets in the presence of calcium metal to about 1000° C. for a period of time sufficient for the oxygen to diffuse from the vandadium metal and react with the calcium forming calcium oxide on the surface of the vanadium, contacting the platelets with an acid to dissolve the calcium oxide, and heating the platelets to about 800° C. under a reduced pressure of about $5\times10^{-5}$ torr to dehydride the platelets, thereby forming a high-purity, low-silicon vanadium metal.

* * * * *